US007070056B2

(12) United States Patent
Powders

(10) Patent No.: US 7,070,056 B2
(45) Date of Patent: Jul. 4, 2006

(54) DRYING RACK FOR POOL FLOATS

(76) Inventor: Stephen Leroy Powders, 741 Lionel Way, Fort Worth, TX (US) 76108

( * ) Notice: Subject to any disclaimer, the term of this patent is extended or adjusted under 35 U.S.C. 154(b) by 43 days.

(21) Appl. No.: 10/770,949

(22) Filed: Feb. 3, 2004

(65) Prior Publication Data

US 2005/0167382 A1 Aug. 4, 2005

(51) Int. Cl.
*A47F 7/00* (2006.01)

(52) U.S. Cl. ..... 211/13.1; 211/27; 211/28; 211/60.1; 211/189

(58) Field of Classification Search ..... 211/27, 211/28, 13.1, 189, 181.1, 60.1, 85.7; D6/552; 297/452.45

See application file for complete search history.

(56) References Cited

U.S. PATENT DOCUMENTS

| | | | | | |
|---|---|---|---|---|---|
| 726,127 | A | * | 4/1903 | Wilbanks | 211/28 |
| 795,152 | A | | 7/1905 | Montgomery | |
| 1,626,282 | A | * | 4/1927 | Jennings | 211/28 |
| 2,087,149 | A | | 7/1937 | Hendrix | |
| 2,604,210 | A | * | 7/1952 | Boone | 211/28 |
| 3,217,893 | A | | 11/1965 | Fleischman | |
| D203,208 | S | * | 12/1965 | Hillman | D34/28 |
| 3,955,826 | A | * | 5/1976 | Riedesel | 280/35 |
| 5,044,505 | A | | 9/1991 | Spratt | |
| D346,081 | S | | 4/1994 | Turner | |
| 5,477,968 | A | | 12/1995 | Largent et al. | |
| 5,639,145 | A | | 6/1997 | Alderman | |
| D401,705 | S | | 11/1998 | Jones | |
| 6,116,438 | A | * | 9/2000 | Lovett | 211/194 |
| 6,171,160 | B1 | | 1/2001 | Skaggs et al. | |
| 6,629,616 | B1 | * | 10/2003 | Heinzle | 211/85.7 |

* cited by examiner

*Primary Examiner*—Jennifer E. Novosad
(74) *Attorney, Agent, or Firm*—Geoffrey A. Mantooth

(57) ABSTRACT

A rack stores various types of pool floats. One type of rack has a top section with spaced apart parallel bars. The bars are separated from each other by slots. The top section is supported above the ground by legs. Mattress type pool floats are received by the slots, with the headrests being located on top of the top section and the body of the mattress being located below. The rack is also ideally suited for auxiliary racks, which can hold chairs and other types of pool floats. The auxiliary racks have at least two spaced apart support bars, which may be at different heights. The auxiliary rack can be located to one side of the mattress rack. The auxiliary rack can hold one or two chairs or other types of floats. In addition, standoffs are provided at the top of the racks, so that a cover may be positioned over the rack.

8 Claims, 6 Drawing Sheets

Fig. 5
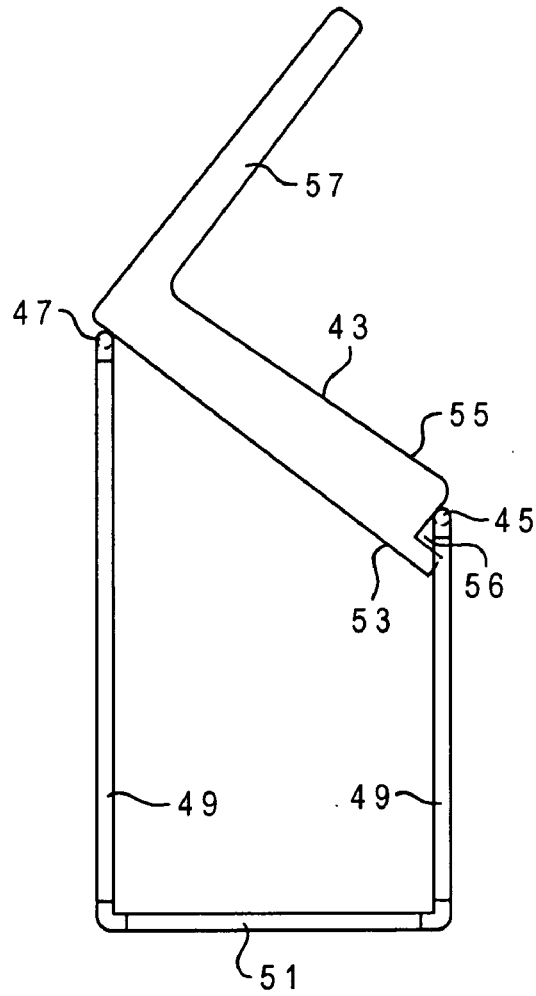
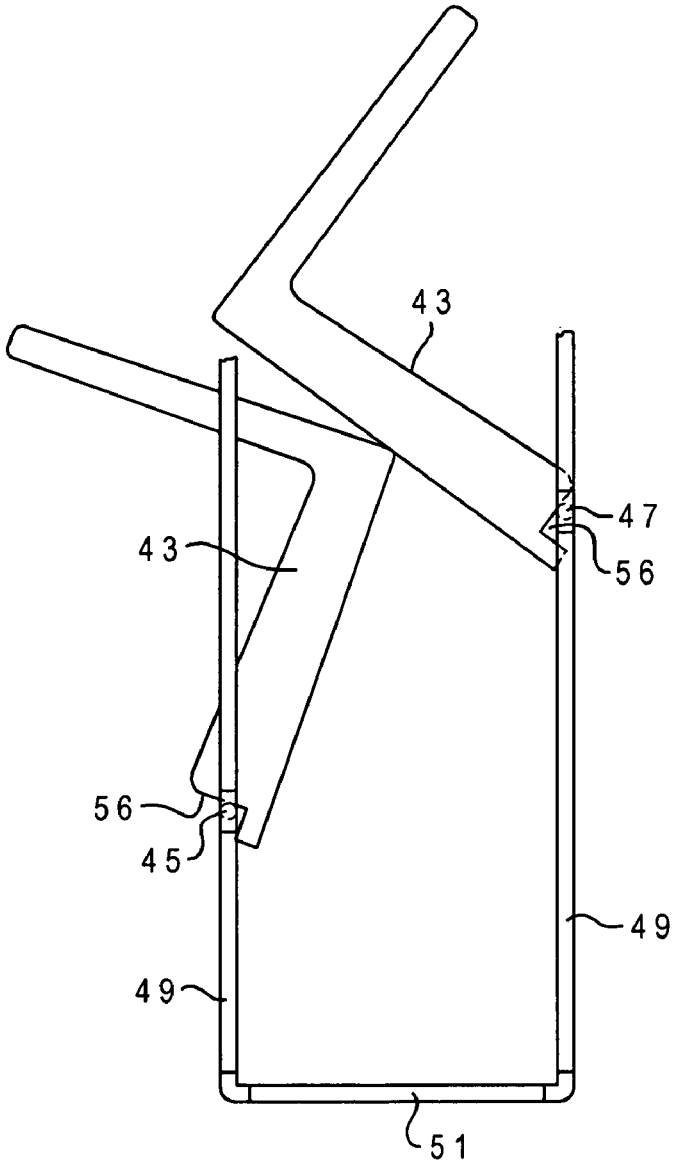
Fig. 7

DRYING RACK FOR POOL FLOATS

FIELD OF THE INVENTION

The present invention relates to racks that hold equipment for drying, and in particular that hold soft pool floats.

BACKGROUND OF THE INVENTION

Swimming pool floats come in a variety of sizes, shapes and materials. Regardless of this variety, the floats are all soft, light in weight and in need of drying after use.

One type of pool float is inflated with air. This type of float includes mattresses, chairs, etc. Another type of pool float is made of foam. The higher quality foam floats have a rubber or plastic coating over the foam.

Equipment owners typically store the floats in a dry place, out of the pool, between uses. This extends the useable life of the floats, which can be shortened due to exposure to pool chemicals and sunlight. Most equipment owners merely stack the floats one on top of another. Foam floats stowed in this manner bend or become indented. The bends and indentations may remain in the float for long periods of time when the float is removed from storage.

Also, stacking the floats may not allow the floats to adequately dry, leading to mildew problems.

Thus, what is needed is a low cost rack for storing pool floats when the floats are not in use.

SUMMARY OF THE INVENTION

It is an object of the present invention to provide a low cost rack for storing pool equipment such as pool floats.

It is another object of the present invention to provide a rack for storing pool floats such that the floats do not suffer indentations or deformation.

It is a further object to provide a rack that allows floats to dry.

The present invention provides a rack for storing mattress-type pool floats. The rack comprises a storage space and a top section located above the storage space. The top section has plural bars with slots between the bars. There are supports for the top section to locate the top section above the storage space. There is also a mattress provided with a headrest. The mattress is located within the slots with the headrest located above the top section and the body of the mattress depending into the storage space.

In accordance with one aspect of the present invention the top section has side bars for connecting to the plural bars.

In accordance with still another aspect of the present invention the top section has slots that extend down the sides of the rack.

In accordance with still another aspect of the present invention there is also provided an auxiliary rack that is coupled to the rack. The auxiliary rack has parallel bars extending laterally out for receiving other floats.

In still another aspect of the present invention the auxiliary rack receives chair floats.

In still another aspect of the present invention, the rack is mounted to a mobile platform. Where there is a combination of a rack and an auxiliary rack, both racks are mounted to a mobile platform.

In accordance with still another aspect of the present invention, the rack has standoffs located above the top section, which standoffs are structured and arranged for receiving a cover.

The present invention also provides a rack for storing pool floats. The rack has first and second storage spaces located adjacent to each other. A top section has plural bars, which bars are parallel to each and spaced apart from each other by slots. Legs support the top section, with the legs positioning the top section above the first storage space. There are two spaced apart support bars, with the second storage space located therebetween.

In accordance with one aspect of the present invention, one support bar is located higher than the other support bar.

In accordance with still another aspect of the present invention, the rack has standoffs located above the top portion which standoffs are structured and arranged for receiving a cover.

In still another aspect of the present invention, there is a mobile platform for moving the first and second storage spaces from one location to another.

BRIEF DESCRIPTION OF THE DRAWINGS

FIG. 5 is an end view taken at lines V—V of FIG. 4, showing how a chair is stored in the auxiliary rack.

FIG. 7 is a side view, taken at lines VII—VII of FIG. 6, showing how two chairs are stacked in the auxiliary rack.

DESCRIPTION OF THE PREFERRED EMBODIMENT

Figure 1:
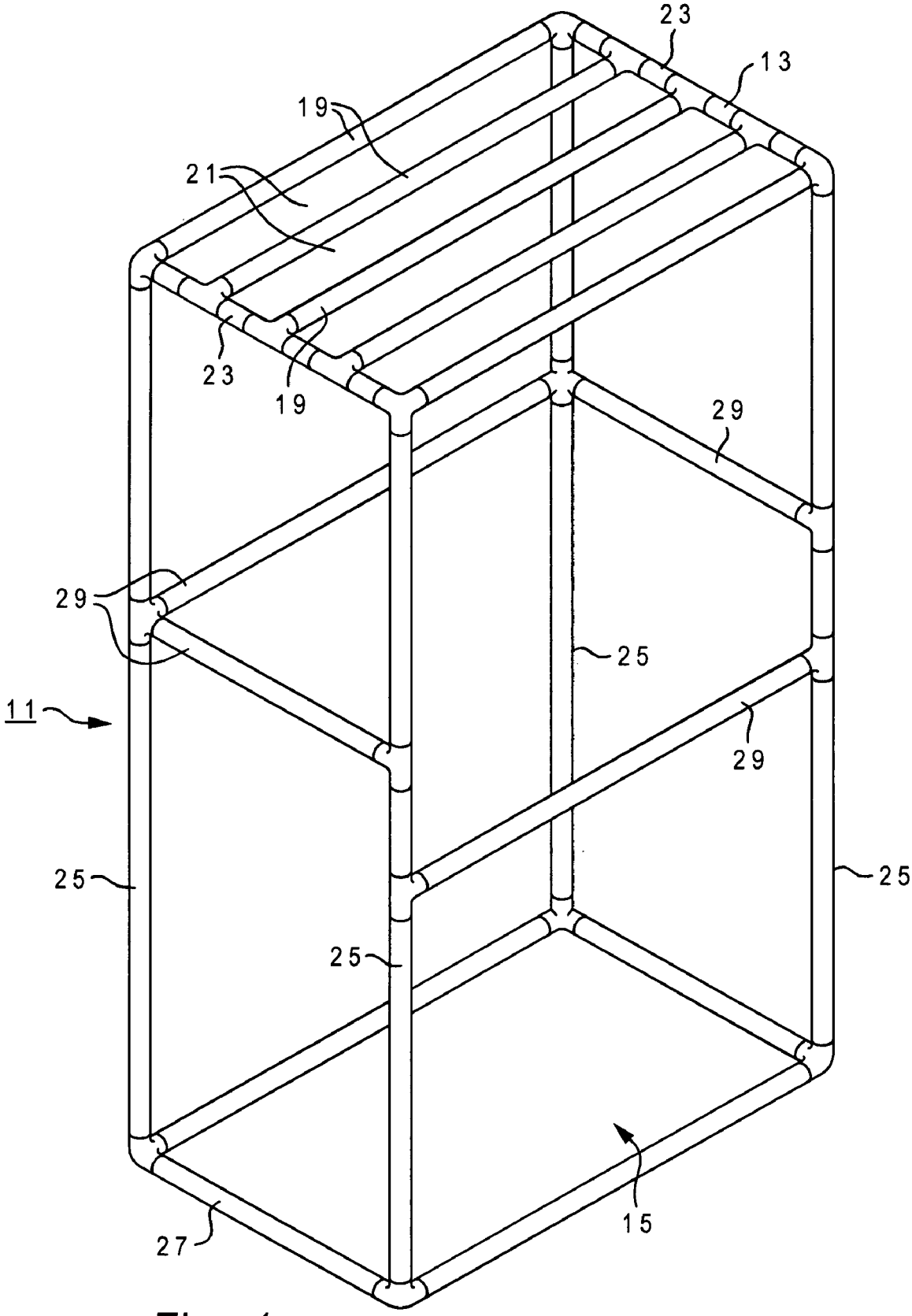
FIG. 1 is an isometric schematic view of the rack of the present invention, in accordance with a preferred embodiment.

In FIG. 1, there is shown the rack 11 of the present invention, in accordance with a preferred embodiment. The rack has a slotted top section 13 located above a storage space 15. Pool floats 17 (see FIG. 2) depend from the top section 13 into the storage space.

Figure 1A:
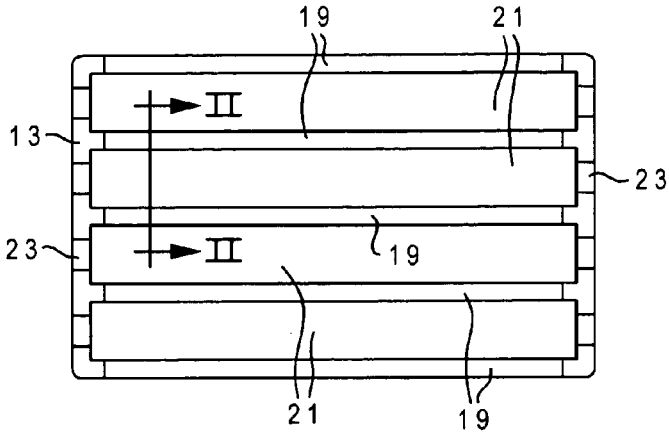
FIG. 1A is a plan view of the top portion of the rack of FIG. 1.
Figure 2:
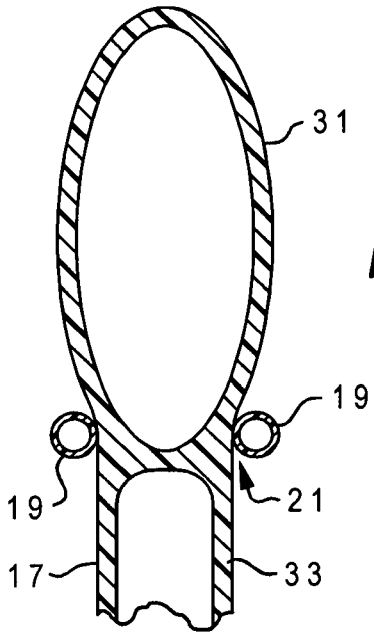
FIG. 2 is a cross-sectional view of the rack, taken through lines II—II of FIG. 1A, showing a mattress-type pool float stored therein.

The top section 13 has a number of bars 19 with pipes arranged in a spaced apart, parallel relationship. As shown in FIGS. 1A and 2, slots 21 are located between the adjacent bars 19, which slots receive the floats 17. The bars 19 are connected at their ends by end bars 23.

The top section 13 is supported off of the ground by supports or legs 25. In the preferred embodiment, where the top section 13 is generally rectangular, there are four legs 25, one on each corner of the top section. There is a bottom section 27, also generally rectangular, having bars that connect the legs 25 together. The top and bottom sections 13, 27 and the legs 25 form a generally box-like structure, with the top section 13 on top to receive and hold the floats, the bottom section 27 to bear on the floor or ground, and the storage space 15 between the two sections to receive the majority of the length of the floats 17. Mid braces 29 are provided to provide structural rigidity between the legs 25. The braces 29 need not be all in one horizontal plane, but can be staggered as shown in FIG. 1.

As shown in FIG. 2, mattress-type pool floats 17 have a headrest 31 and a body portion 33. The body portion 33 is generally flat, while the headrest 31 forms a bulge. To store a float 17, the body portion 33 is inserted into a slot 21 from above the rack 11. The headrest 31 is wider than the slot 21. The float is pushed into the rack storage space 15 until the headrest 31 bears on the bars 19. Thus, the float is suspended by the adjacent bars 19, as shown in FIG. 2, with the headrest 31 above the bars 19 and the body portion 33 located inside the storage space below 15. This arrangement is different than other storage arrangements which have the floats bearing on each other or bent over bars or racks. This arrangement stores a pool float with little or no deformation or indentations in the foam material making up the float.

Each slot 21 can receive a float. With the rack 11 shown in FIGS. 1 and 1A, the capacity is four floats. The rack can be made to accommodate fewer or more floats by providing fewer or more slots.

The rack 11, as well as the other racks discussed herein, are made of PVC pipe and couplings. The bars and legs (for example, 19, 23, 25, 29) are made of PVC pipe, such as 1–1½ inch diameter pipe. The pipes are coupled together at their ends. The couplings vary from T-fittings (such as to join the end of a brace 29 to a leg 25 or to join the end of a bar 19 to an end bar 23) to three way couplings (such as at a corner where a leg 25 couples to either the top or bottom portion 13, 27). Conventional solvent welding or other adhesive is used to join the PVC pipes and couplings together. The resulting rack is light in weight, sturdy and inexpensive.

Figure 3:
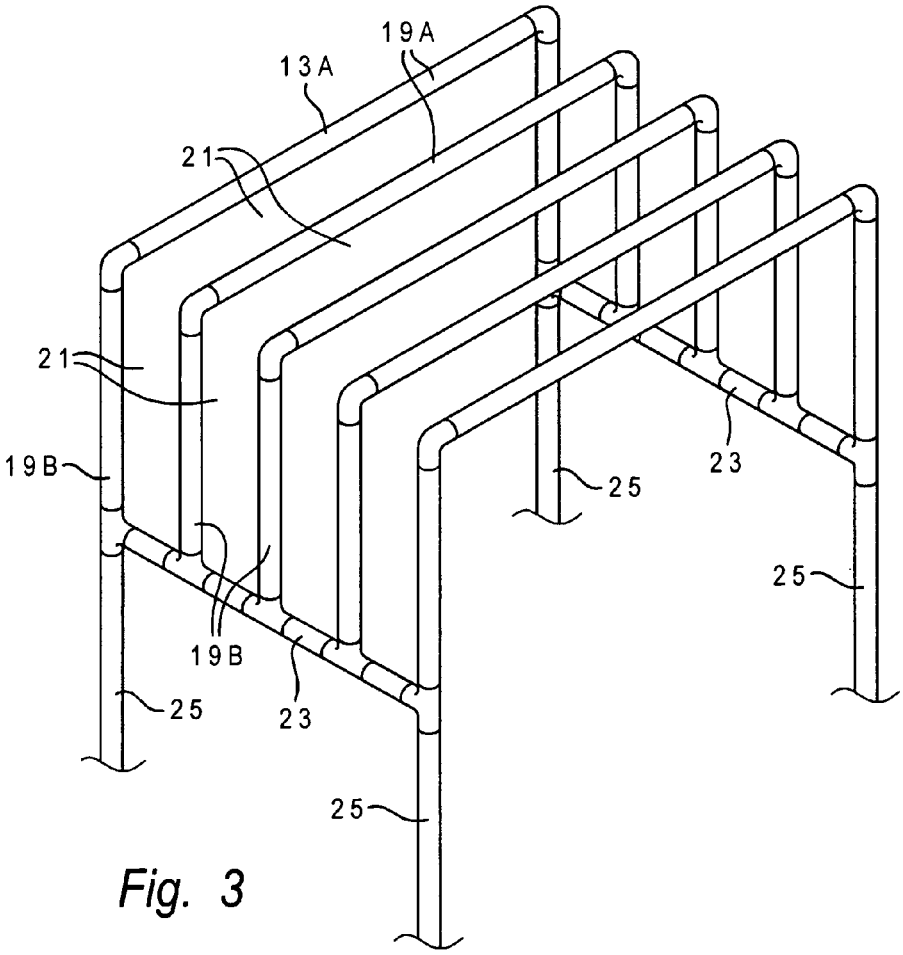
FIG. 3 is an isometric schematic view of the top portion of the rack, in accordance with another embodiment.

The rack 11 should be as high as the longest pool float, in order to avoid the stored float from contacting the ground and deforming. Some floats may be tall, making removal from the rack difficult, unless a step stool is used. FIG. 3 shows a top portion 13A in accordance with another embodiment, wherein the slots 21 extend down a portion of the sides of the rack. This allows the floats to be inserted and removed from the side of the rack, a useful feature if the rack is tall. The bars have horizontal portions 19A as in the embodiment in FIGS. 1 and 1A. In addition, the bars have side portions 19B that extend to the end bar 23. Elbow connectors are used between the horizontal and side bars 19A, 19B.

Figure 4:
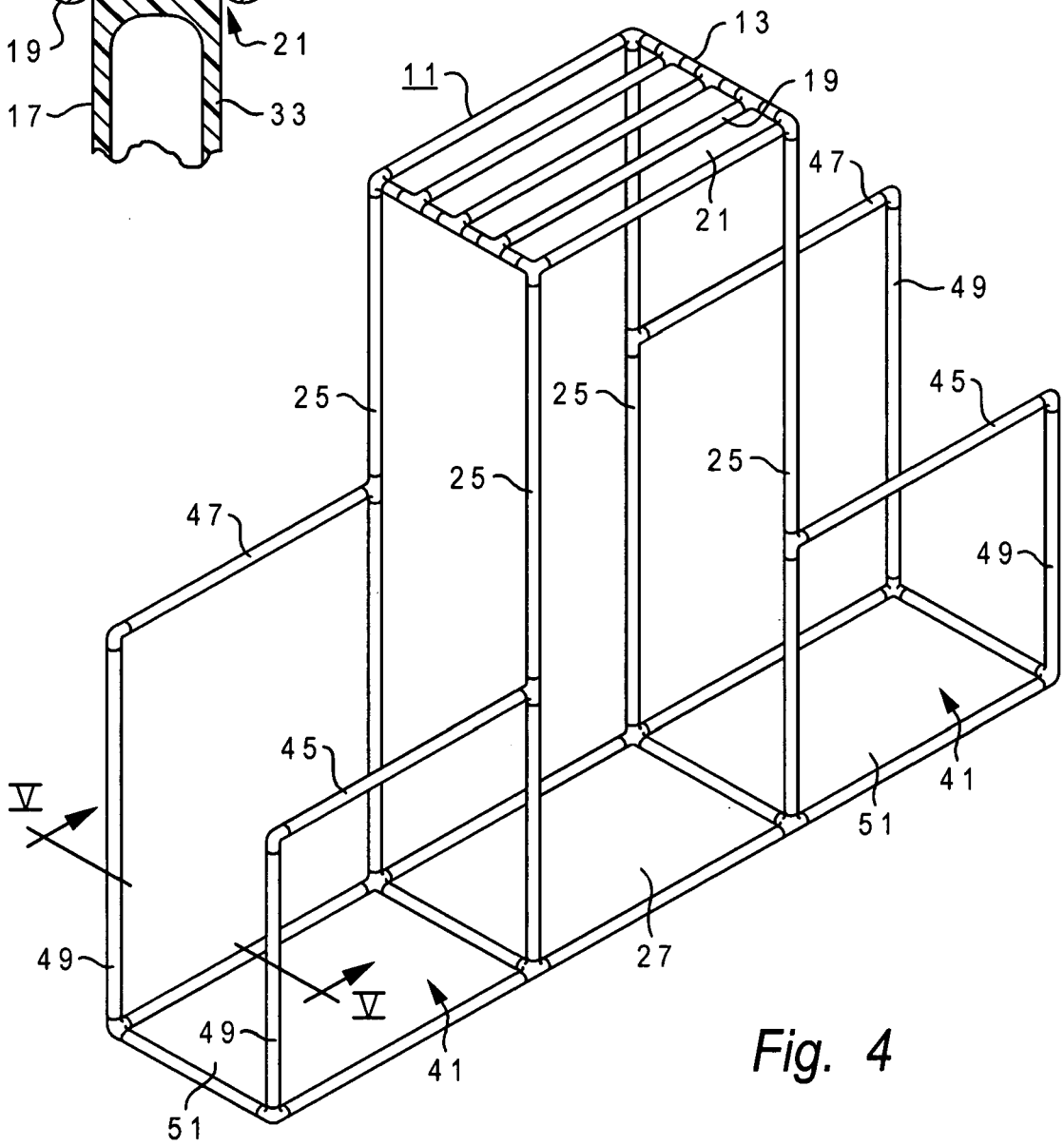
FIG. 4 is an isometric schematic view of the pool rack of FIG. 1, with auxiliary racks for storing other types of floats such as chairs.

FIGS. 4 and 5 show the rack 11 equipped with auxiliary racks 41, which auxiliary racks are used for storing other types of pool floats, such as chairs 43. There can be one or two auxiliary racks 41, with each rack extending from the side of the rack 11. Each auxiliary rack 41 has first and second horizontal bars 45, 47, that are staggered in height, with one bar being lower than the other bar. The horizontal bars 45, 47 extend laterally from respective legs 25 of the rack 11. The free ends of the bars 45, 47 are supported by legs 49. The auxiliary racks 41 each have a bottom section 51 that extends from the rack bottom section 27 to the legs 49.

FIG. 5 shows one way to store a chair 43 in an auxiliary rack 41. The chair 43 has a base or seat 53, upon which a user sits, armrests 55 and a back 57. A nook 56 or corner is formed at the junction of each armrest 55 and seat 53. The base 53 is inserted into the auxiliary rack, so as to bear upon the higher bar 47. The corner 56 between the armrest and seat is positioned so as to bear on the lower bar 45. The bars 45, 47 in turn bear on the legs 25 and 49.

Figure 6:
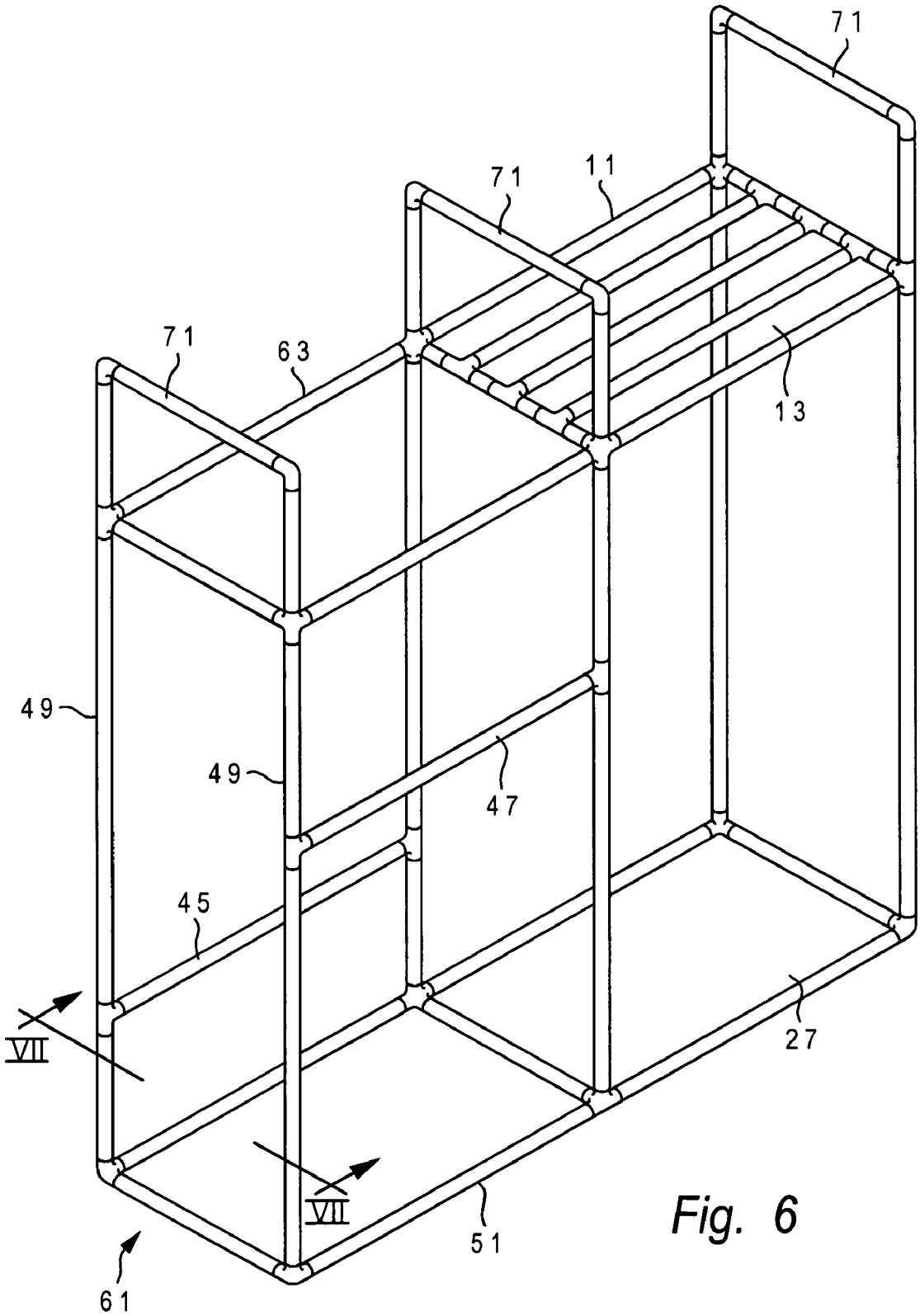
FIG. 6 is an isometric schematic view of the pool rack of FIG. 1, with another auxiliary rack for storing two chairs.

FIGS. 6 and 7 show a rack combination with the rack 11 and an auxiliary rack 61 for storing two chairs 43. The auxiliary rack 61 is similar to the auxiliary rack 41, having horizontal bars 45, 47. The legs 49 extend up to a top section 63. Thus, the auxiliary rack forms a box-like structure, with the top and bottom sections 63, 51 and bars 45, 47 used to support chairs for other floats in the rack.

FIG. 7 shows how to store two chairs 43 in the auxiliary rack 61. One chair bears on the lower bar 45 while the other chair bears on the upper bar 47. The chairs receive the bars 45, 47 by the corners 56 formed by the armrest. The bottom of the seat of the upper chair bears on the back of the lower chair. This storage arrangement produces little or no deformation or indentation in the chair floats.

FIG. 6 also shows provisions for a cover. Each top section has standoffs 71, with each standoff being an inverted "U" shaped portion. The standoffs 71 create a space above the top portions 13, 63.

Figure 8:
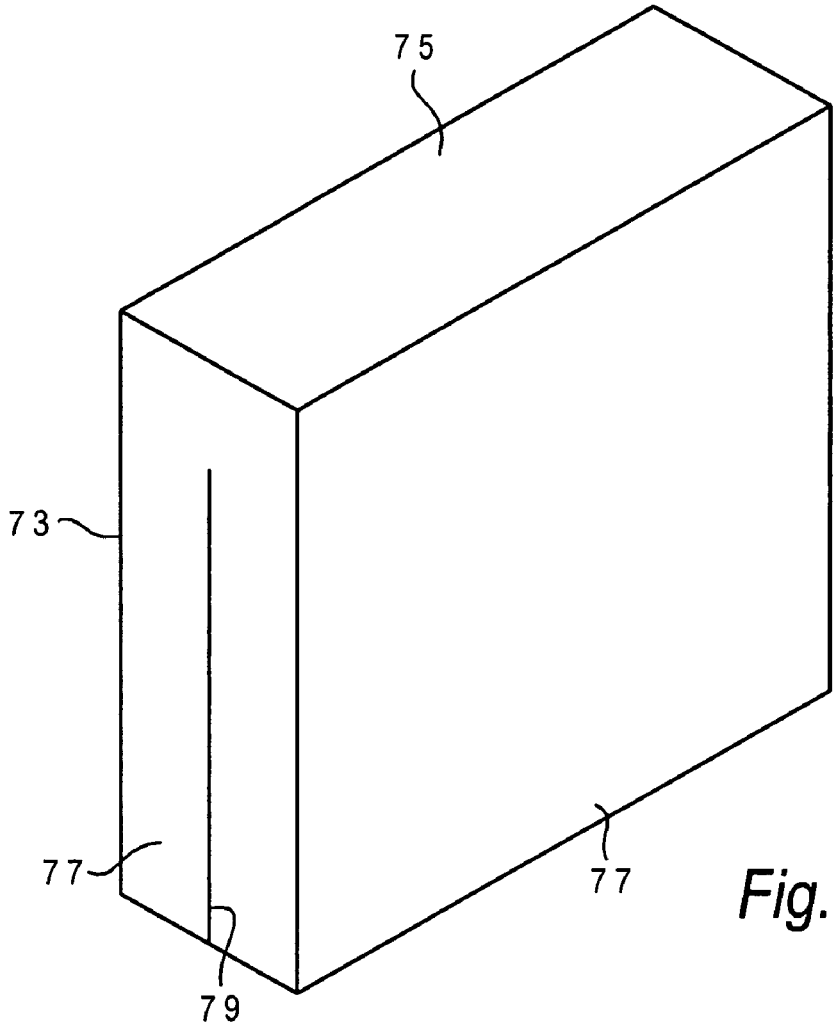
FIG. 8 is an isometric view of the cover for the rack arrangement of FIG. 6.

The cover 73, as shown in FIG. 8, is shaped like the rack combination 11, 61, being slighter larger. The cover 73 has a top 75 and sides 77. The top is solid while the sides 77 can be either solid or mesh. The mesh allows air to circulate through the rack, facilitating drying of the floats therein. Slits 79 can be provided in at least some of the sides so as to facilitate the insertion and removal of the cover onto the rack combination. The slits can be closed with hook and loop fasteners. Also, the cover can be secured to the bottom sections by hook and loop fasteners.

The auxiliary rack or racks 41, 61 can be coupled to the rack 11 by fittings, such as four way couplings or, in the case where the standoffs couple to the racks, five way couplings. In the alternative, the auxiliary racks can be made as stand alone units. If the racks are used in combination, then the respective legs of the racks can be coupled together such as by ties.

Figure 9:
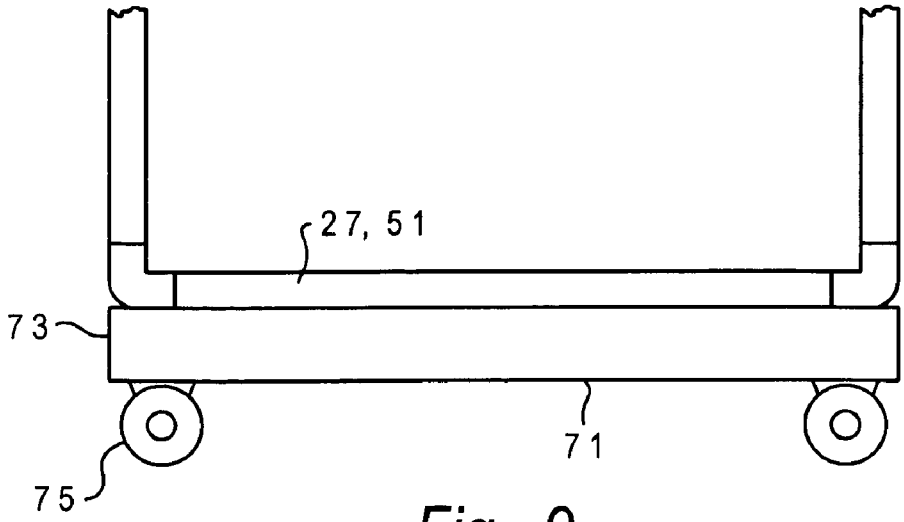
FIG. 9 is a side elevational view of the bottom section of one of the racks, shown with a mobile platform.

The racks 11, 41, 61 can be located directly on the ground. Alternatively, the racks can be located on a mobile platform for moving the racks from one location to another. FIG. 9 shows such a mobile platform 71. The platform has a base 73 mounted upon wheels 75 or casters. The bottom section 27, 51 of the rack is mounted onto the base 73 and secured thereto (for example, by bolts).

A single platform can be used to accommodate a number of racks, which racks are coupled together into a unit.

The foregoing disclosure and showings made in the drawings are merely illustrative of the principles of this invention and are not to be interpreted in a limiting sense.

The invention claimed is:

1. A rack for storing mattress-type pool floats, comprising:

a) a storage space;

b) a top section having a plurality of bars, which bars are spaced apart from each other by slots;

c) supports for the top section, the supports locating the top section above the storage space;

d) a float mattress comprising a body portion and a headrest;

e) the mattress being received by one of the slots such that the headrest is above the top section when the body of the mattress is located within the storage space.

2. The rack of claim 1 wherein the bars in the top section are parallel to each other and have ends, the top section comprising end bars that are coupled to the ends of the parallel spaced apart bars.

3. The rack of claim 1 wherein the slots of the top section have ends that are open.

4. The rack of claim 1 further comprising an auxiliary rack comprising parallel bars that extend laterally out from the supports, which parallel bars receive other types of floats.

5. The rack of claim 4 wherein the other floats comprise chairs.

6. The rack of claim 4 further comprising a mobile platform, the rack and the auxiliary rack being mounted to the mobile platform.

7. The rack of claim 1 further comprising standoffs located above the top section, which standoffs are structured and arranged to receive a cover.

8. The rack of claim 1 further comprising a mobile platform, the rack being mounted to the mobile platform.

* * * * *